US006579040B2

(12) United States Patent
Karayaka

(10) Patent No.: US 6,579,040 B2
(45) Date of Patent: Jun. 17, 2003

(54) METHOD AND APPARATUS FOR AIR CAN VENT SYSTEMS

(75) Inventor: Metin Karayaka, Houston, TX (US)

(73) Assignee: CSO Aker Maritime, Inc., Houston, TX (US)

( * ) Notice: Subject to any disclaimer, the term of this patent is extended or adjusted under 35 U.S.C. 154(b) by 0 days.

(21) Appl. No.: 09/917,564

(22) Filed: Jul. 26, 2001

(65) Prior Publication Data

US 2003/0021635 A1 Jan. 30, 2003

(51) Int. Cl.[7] ..... F16L 1/12; E02B 17/02

(52) U.S. Cl. ..... 405/224.2; 405/162; 405/171; 405/211; 405/224.4; 166/350; 166/367; 175/8

(58) Field of Search ..... 405/162, 171, 405/195.1, 211.1, 211, 216, 224.2–4; 166/350, 355, 359, 367; 114/243, 331; 175/5–8

(56) References Cited

U.S. PATENT DOCUMENTS

| | | | | |
|---|---|---|---|---|
| 3,855,656 A | * | 12/1974 | Blenkarn | 175/7 X |
| 3,858,401 A | * | 1/1975 | Watkins | 405/224.2 |
| 3,952,526 A | | 4/1976 | Watkins et al. | |
| 3,981,357 A | * | 9/1976 | Walker et al. | 166/359 |
| 3,992,889 A | * | 11/1976 | Watkins et al. | 405/224.2 |
| 4,234,047 A | * | 11/1980 | Mott | 166/350 X |
| 4,422,801 A | * | 12/1983 | Hale et al. | 405/171 |
| 4,511,287 A | | 4/1985 | Horton | |
| 4,557,332 A | * | 12/1985 | Denison et al. | 166/355 X |
| 4,636,114 A | | 1/1987 | Hale | |
| 4,646,840 A | * | 3/1987 | Bartholomew et al. | 166/350 |
| 4,702,321 A | | 10/1987 | Horton | |
| 5,758,990 A | | 6/1998 | Davies et al. | |
| 6,004,074 A | * | 12/1999 | Shanks, II | 405/195.1 |
| 6,257,337 B1 | * | 7/2001 | Wells | 166/350 |
| 2001/0000718 A1 | | 5/2001 | Blevins et al. | |

FOREIGN PATENT DOCUMENTS

| | | | | |
|---|---|---|---|---|
| EP | 39589 | * | 1/1981 | 405/224.2 |

OTHER PUBLICATIONS

P. Cary & D. Eaton, "A Simple Method for Resolving Large Converted–wave (P–SV) Statics," Geophysics, vol. 58, No. 3 (Mar. 1993), p. 429–433.

* cited by examiner

*Primary Examiner*—Heather Shackelford
*Assistant Examiner*—Jong-Suk (James) Lee
(74) *Attorney, Agent, or Firm*—Klein, O'Neill & Singh, LLP

(57) ABSTRACT

An air-can riser tensioning device for use in the production of oil and gas at offshore locations includes at least one air-can used to place a vertical force on the riser. The air-can includes an open port that extends into the water toward the sea floor to a depth sufficient to prevent water from entering or air from leaving the air-can during its upward and downward vertical movements while in use. A manufacturing method includes fabricating the air-cans out of one material and fabricating the open port out of another material, and in particular making the open port from a material that is more corrosion resistant than the material the air-can is fabricated from. The manufacturing method further includes fabricating a passage in one soft tank for fluid communication with a second soft tank, and connecting the second soft tank with the passage.

11 Claims, 5 Drawing Sheets

METHOD AND APPARATUS FOR AIR CAN VENT SYSTEMS

BACKGROUND OF THE INVENTION

The invention is generally related to risers for floating offshore oil and gas production structures and more particularly to air-can tensioning devices for the risers.

In the production of oil and gas at offshore locations, it is necessary to support the risers used in production and drilling operations. Air-can tensioning devices are commonly used to provide such support. The air-cans use buoyant forces to support and over tension the risers that extend from the structure down to the sea floor. Referring now to FIGS. 1 and 2, a conventional air-can 7 is seen located around stem 32. Lower sections have open ports 30*a*–30*c* and are pressurized via air-lines 5*a*–5*c*. The segments 10, 15, 20, and 25 are sealed from each other and have independent air-lines 5*a*–5*c* attached to segments 15, 20 and 25 respectively to provide for redundancies. The upper-most segment 10 is not only sealed from the other segments 15 through 25 but is also sealed from fluid contact with any surrounding water, having no open port. The lower segments 15, 20, and 25 have open ports 30*a*–30*c* to compensate for the high pressures the lower segments see at depth. Without an open port, the deeper a segment is submerged, the greater its wall thickness has to be to avoid collapse, reducing the segments buoyancy. With an open port and pressure from above, thin segment walls are available.

FIG. 2 shows the cross-sectional view of FIG. 1 where air-lines 5*a*–5*c* are located around stem 32. The conventional stem 32 is sized to have an inner diameter that is larger than the outer diameter of a riser such that the stem 32 is readily received around a riser.

Segments with open ports are commonly called "soft tanks" or "variable buoyancy tanks." Those that are closed are called "hard tanks." Although FIG. 1 shows one hard tank and multiple soft tanks, in practice, multiple hard tanks are used at the top and multiple soft tanks are used at the bottom in a given air-can arrangement. It is also noted that it is not necessary that the tanks be connected to one another in a series arrangement where the air-lines pass through the upper tanks to reach the lower tanks as shown in FIG. 1. One alternative tank arrangement is described by Davies in U.S. Pat. No. 5,758,990, incorporated herein by reference, where a stem having an inner diameter larger than the outer diameter of the riser is positioned around the riser and is fastened in position at the wellhead of the riser on the offshore structure; a yoke attached to the stem supports a number of sleeves around the stem; each sleeve receives a variable buoyancy air can; and the sleeves and air cans are provided with a retainer that retains the air cans in the sleeves and transfers the vertical loads of the air cans to the sleeve.

There are problems, however, with the tanks described above. First, in practice, one cannot pump out all the fluid through the open port in a soft can. FIG. 3 illustrates this problem showing a soft tank 45 including air-line 35 for introducing gases 40, typically air, into soft tank 45 and water 55, indicated by hash marks, below the open port 60. There is a level below which the soft can cannot be evacuated due to the conventional placement and design of the open port. Additionally, in practice, the soft tanks see upward and downward motion. When the tank is moved up, during heave, the water level in the soft tank will drop and the air will escape causing the need to pump more air into the soft tank. To avoid this during normal operations, the water level is left above the open port. Thus, not only the volume below the port is lost for buoyancy, but also some volume above the port is lost. Further, when there is pitch due to wave action at the surface and other forces, the water surface level in the soft tank can drop below the open port, causing air to escape. So, the water level is kept even higher than what would be needed without pitch. Again, volume of the tank is lost for buoyancy.

Downward motion can be caused by forces at the surface or other forces. For a "spar" structure, as described in U.S. Pat. No. 4,702,321, incorporated herein by reference, as the spar moves laterally, the spar is "offset" from its nominal position. The risers pull the tanks lower in the water, causing the water level in the soft tanks to rise, due to the increase in pressure, again causing a decrease in the available volume for buoyancy, at least without pumping more gases into the soft tank or designing for the offset position, leaving an overcapacity in the soft tank when the spar is in the nominal position.

There is a need therefore, to address the above-mentioned problems.

SUMMARY OF THE INVENTION

A riser tensioning device according to the invention comprises a first tank having a central axis; a first passage having a diameter less than the inner diameter of the first tank; the first passage providing a fluid contact between the interior of the first tank and the exterior of the first tank; and the first passage having a portion extending outside the first tank at an angle less than 90 degrees from parallel to the central axis. In one embodiment of the first tank, the first passage is attached in fluid communication with the interior of the first tank at the bottom of the first tank. In one embodiment of the first tank, the first passage is attached in fluid communication with the interior of the first tank at the side of the first tank. In still another embodiment of the first tank, a gas line is in fluid contact with the interior of the first tank.

In a particular embodiment of the invention, the riser tensioning device comprises a second tank having a central axis; a stem connected to the first tank; a second passage having a diameter less than the inner diameter of the second tank; the second passage providing a fluid contact between the interior of the second tank and the exterior of the second tank with the water and the second passage having a portion extending outside the second tank at an angle less than 90 degrees from parallel to said central axis. In one embodiment of the second tank, the passage is attached in fluid communication with the interior of the second tank at the bottom of the second tank. In one embodiment of the second tank, the second passage is attached in fluid communication with the interior of the second tank on the side of the second tank. In one embodiment of the second tank, the second tank is attached to the stem. In still another embodiment of the second tank, the second tank is attached to the first tank.

In a particular embodiment of the attached tanks, the first passage is providing a fluid contact between the interior of the first tank and the exterior of the first tank while passing through the second tank. In one embodiment of the attached tanks, the second tank is attached to the first tank by a stem. In one embodiment of the attached tanks, a gas line is in fluid connection with the interior of the second tank. A particular embodiment of the invention includes the gas line in fluid connection with the interior of the second tank where the gas line passes through the first tank.

In still another embodiment of the invention, the first tank comprises an interior surface having a first corrosion resistance and the first passage has an interior surface having a second corrosion resistance where the second corrosion resistance is greater than the first corrosion resistance. In one particular embodiment, the interior surface having a second corrosion resistance is selected from a group consisting essentially of stainless steel, fiber reinforced pipe, or rubber. In one particular embodiment, the interior surface having a second corrosion resistance is selected from a group consisting essentially of rust inhibiting paint, epoxy, electroplated metals, or thermal sprayed aluminum.

A method of manufacturing a riser tensioning device comprising providing a first tank having an interior surface of a first material; connecting to the first tank a fluid passage having an interior surface of a second material in which the second material is more corrosion resistant than the first material. In one embodiment of the method, the second material comprises stainless steel. In one embodiment of the method, the second material comprises fiber reinforced pipe. In one embodiment of the method, the second material comprises rubber hose. In one embodiment of the method, the second material comprises rust inhibiting paint. In one embodiment of the method, the second material comprises epoxy. In one embodiment of the method, the second material comprises electroplated metal. In one embodiment of the method, the second material comprises thermal sprayed aluminum. In another embodiment of the method, a second tank is provided where the connection of the fluid passage to the first tank is made through the second tank.

A method of providing buoyancy to a riser when in water, the method comprising holding a volume of gas in mechanical connection with a riser; providing a fluid passage between the volume of gas and the water; allowing water to move within the passage in response to vertical motion of the riser while resisting a change in the volume of gas as a result of the vertical motion of the riser. In one embodiment of the method, gas is provided to the volume of gas.

A system for providing buoyancy to a riser when in water, the system comprising means for holding a volume of gas in mechanical connection with the riser, means for providing a fluid path between the volume of gas and the water, means for allowing water to move within the fluid path in response to vertical motion of the riser while resisting a change in the volume of gas as a result of the vertical motion of the riser. One embodiment of the system further comprises means for providing gas to said volume of gas. In one embodiment of the system, the means for holding comprises a tank connected to the riser. In one embodiment of the system, the means for providing a fluid path comprises a passage from the gas to the water wherein a cross-sectional area of the passage is less than a cross-sectional area of the means for holding. In one embodiment of the system, the means for allowing water to move within the fluid path comprises a passage having a length greater than an anticipated vertical motion of the riser.

DETAILED DESCRIPTION OF EXAMPLE EMBODIMENTS OF THE INVENTION

Figure 4A:
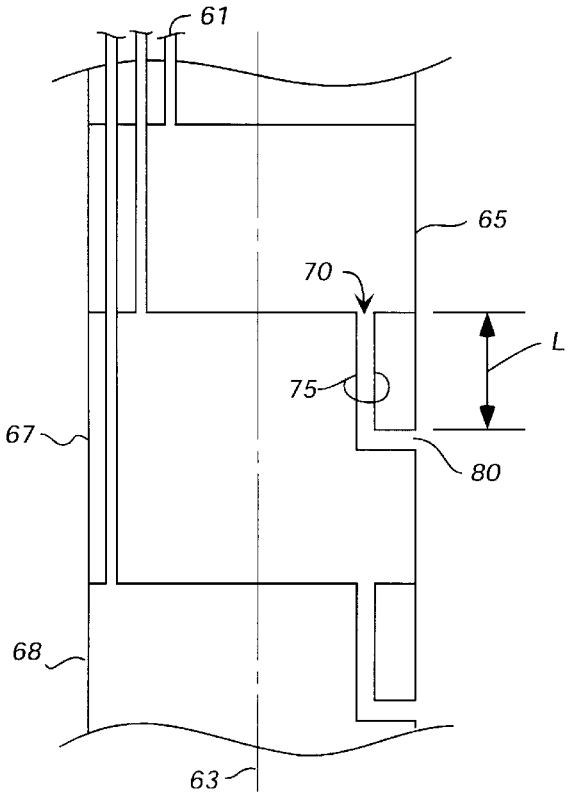
FIG. 4*a* shows an embodiment of a vent system for an air can where the vent passage travels through a lower air can.
Figure 4B:
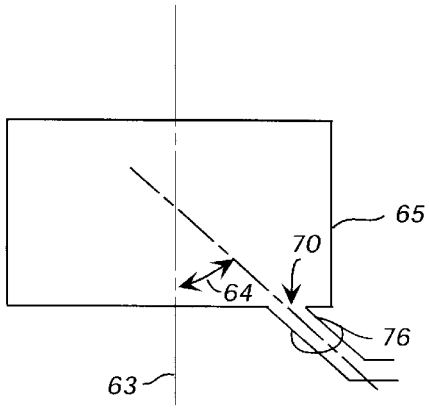
FIG. 4*b* shows an alternative embodiment where the vent passage extends outside the soft tank at an angle less than ninety degrees from parallel to the central axis.
Figure 4C:
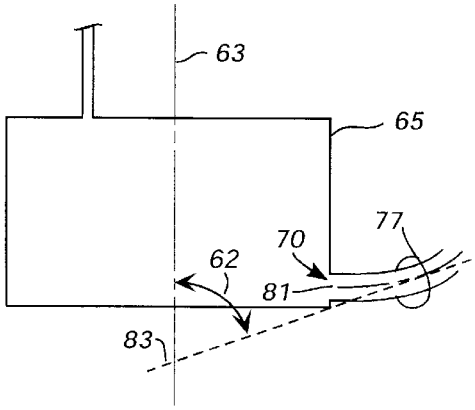
FIG. 4*c* shows another embodiment of an air can vent system similar to FIG. 4*b*.

Referring now to FIG. 4*a*, an example embodiment of the invention is seen in which soft tank segment 65 having central axis 63 is pressurized by airline 61 and comprises an opening 70, which is connected to the "fluid path" or passage 75. Opening 70 has a cross-sectional area less than the cross-sectional area of soft tank 65. The passage 75 passes through soft tank 67 and is vented to the exterior of soft tank 67 at opening 80. It is noted that airline 61 is not a required element of soft tank 65. In one alternative embodiment, air is introduced into soft tank 65 through passage 75 via an airline, not shown, in fluid contact with passage 75. Although FIG. 4*a* shows the passage having a ninety-degree elbow, it is not necessary that the passage include any elbow at all. As seen in FIGS. 4*b* and 4*c*, the opening 70 is located in alternative embodiments, attached to the bottom and side of soft tank 65 respectively, each using external passage ways 76 and 77 respectively. FIG. 4*b* illustrates an alternative embodiment where a portion of passage 76 extends outside tank 65 at an angle 64 less than ninety-degrees from parallel to central axis 63. In another alternative embodiment, a portion of passage 77 extends outside tank 65 at an angle 62 less than ninety-degrees from parallel to central axis 63, as seen in FIG. 4*c*. Angle 62 is defined as the angle between the central axis 63 and a line 83 drawn tangent to a point along a portion of passage 77's centerline 81. It is also not necessary that the passage 75 in FIG. 4*a* be vented at soft tank 67. In alternative embodiments, the passage 75 passes through and is vented from, not shown, lower soft tanks, such as soft tank 68. Also, in the illustrated example, opening 70 is located at the bottom of soft tank 65 allowing the evacuation of water from the soft tank.

Figure 1:
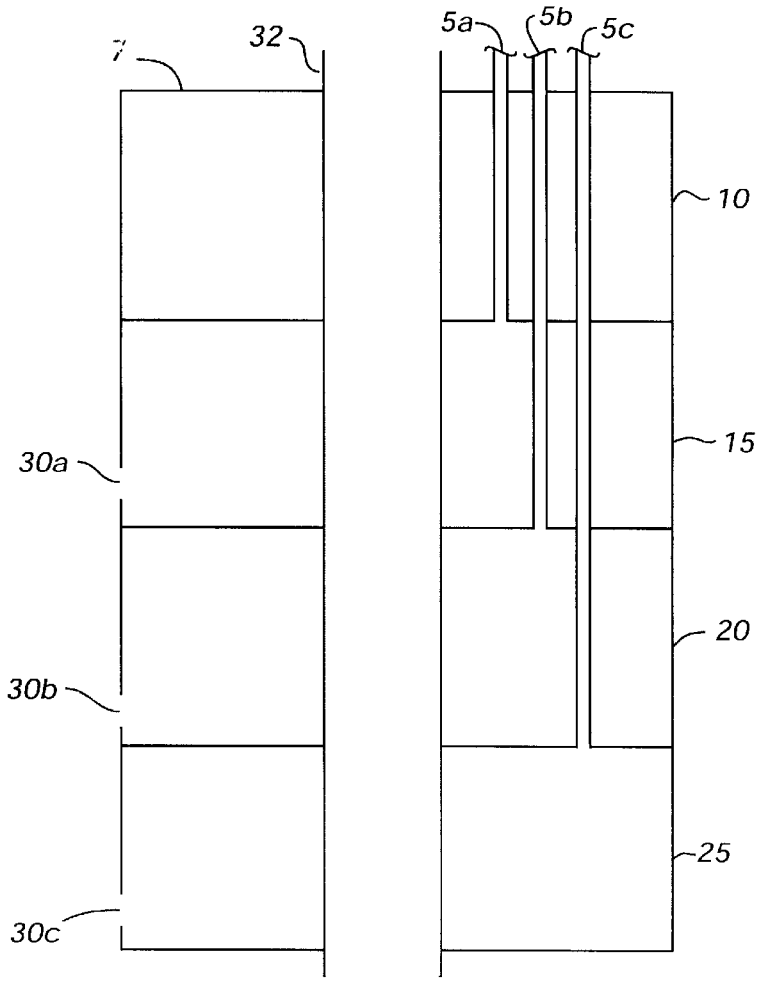
FIG. 1 shows a representative air can assembly.
Figure 2:
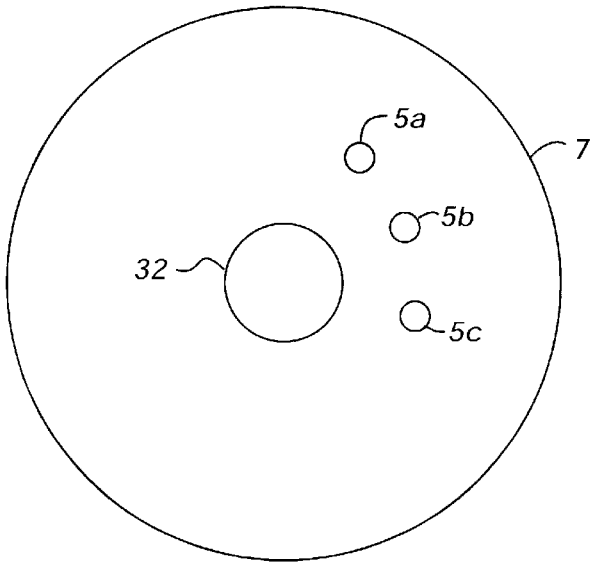
FIG. 2 is a cross sectional view of the air can assembly in FIG. 1.
Figure 3:
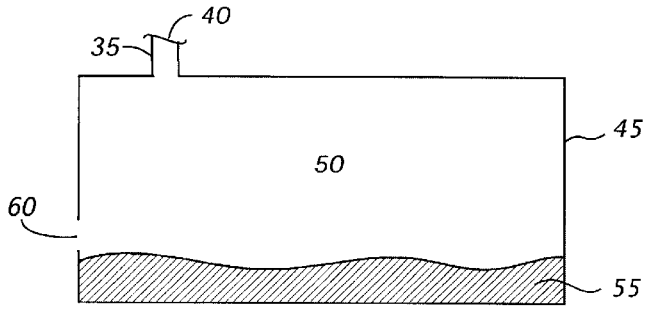
FIG. 3 shows a soft can containing water below the open port that cannot be pumped out.
Figure 5:
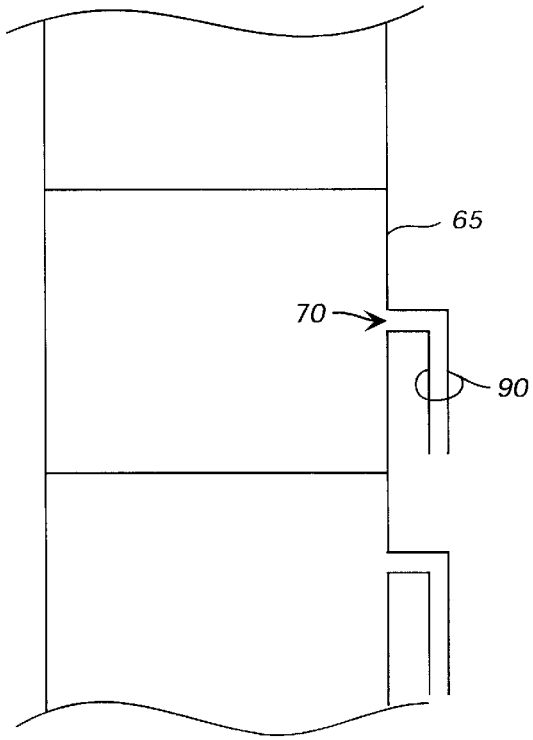
FIG. 5 shows an embodiment of an air can vent system where the vent passage is connected to the side of a soft tank using an external passageway.
Figure 6:
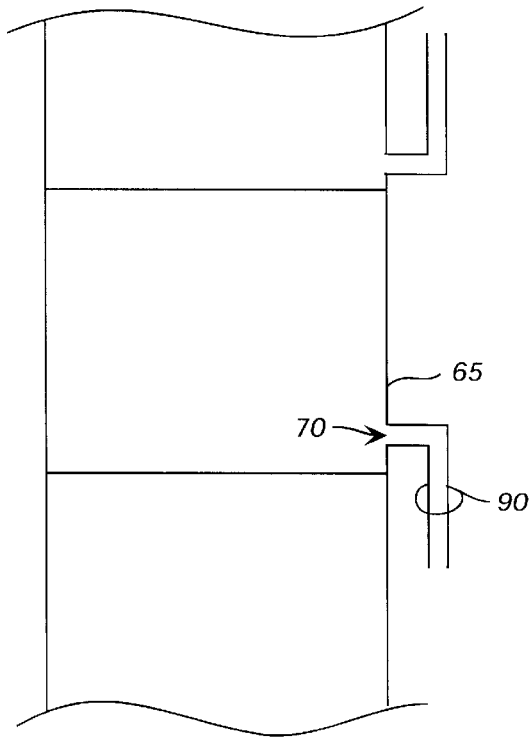
FIG. 6 shows another embodiment of an air can vent system similar to FIG. 5.

It should be understood that the evacuation of water does not mean the complete elimination of all moisture from within an air can, it means the expulsion of most of the water from a soft tank as compared to the amount of water that can be evacuated from a conventional soft tank. As seen in FIGS. 5 and 6 however, the opening 70 is located in alternative embodiments, attached to the side of soft tank 65, each using external passageway 90. For example, in alternative embodiments of the invention, the side of soft tank 65 is attached via fasteners, jam nuts, threaded hole connections, weldments, or any attachment techniques known for holding two structures or structural components together. The embodiments illustrated by FIGS. 5 and 6 will not have the problems with evacuating water from the soft tank as described in FIG. 3 above as long as the tank is designed such that no water can enter. In one alternative embodiment, the length of passage 90, in FIGS. 5, is designed such that water cannot enter the soft tank 65. Alternative methods using alternating passage lengths and air pressures from airlines, not shown, as well as using valves and other passage restriction devices, not shown, will occur to those of skill in the art.

Referring again to FIG. 4*a*, the distance L between opening 70 and passage 75's exterior opening 80 is equal to or greater than the sum of the expected vertical distance the soft tank is expected to travel in use. Distance L is determined in some embodiments by calculating the expected change in pressures the soft tank will see as it moves from its nominal depth to other depths during the soft tank's expected vertical travel and calculating the amount of vertical distance the water in the passage will move as a function of passage diameter and gas pressure in the soft tank. Shorter or longer lengths are used in alternative embodiment of the invention. Alternative methods of calculating distance L will occur to those of skill in the art.

Figure 7:
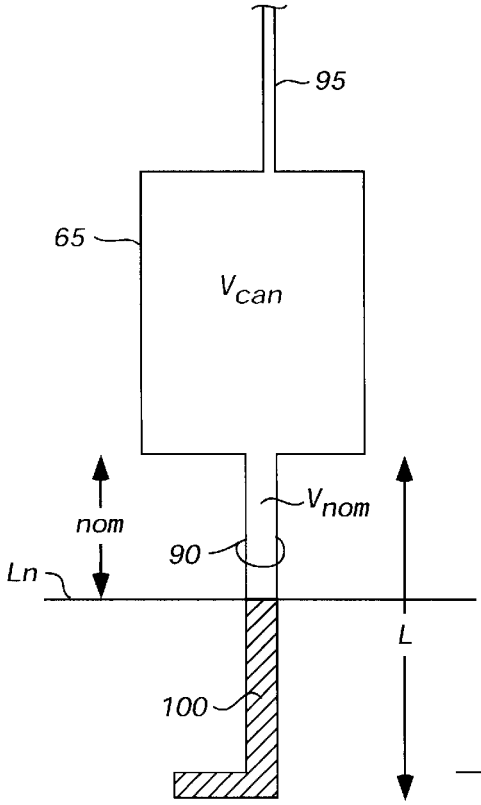
FIG. 7 shows a single air can with air vent passage connected to the bottom of a soft tank where the air can is at a "nominal" depth.
Figure 8:
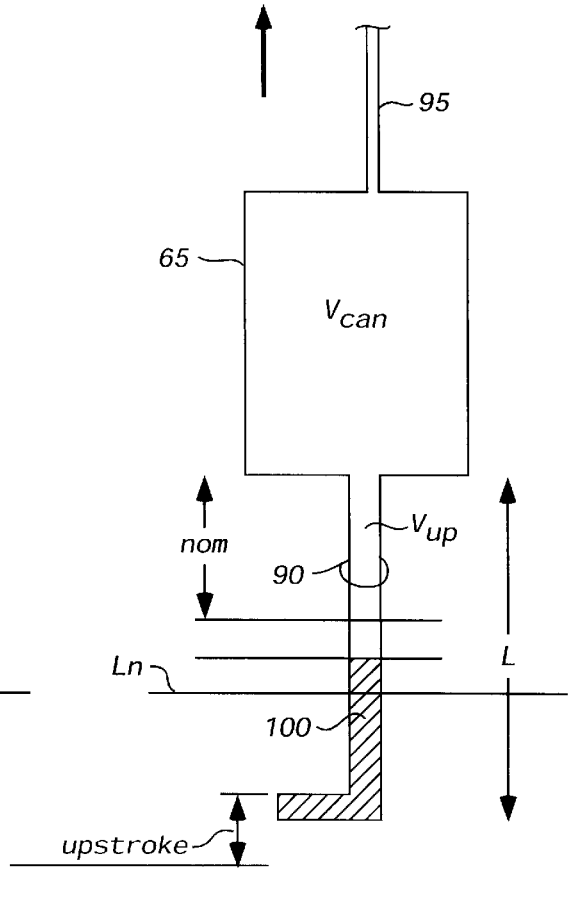
FIG. 8 shows the air can in FIG. 7 during an "upstroke" movement and illustrates that the volume in the passage increases.
Figure 9:
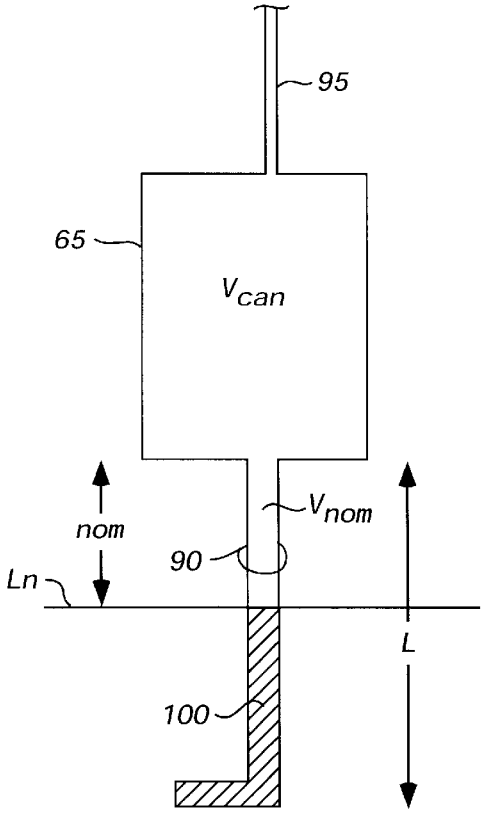
FIG. 9 is the same as FIG. 7.
Figure 10:
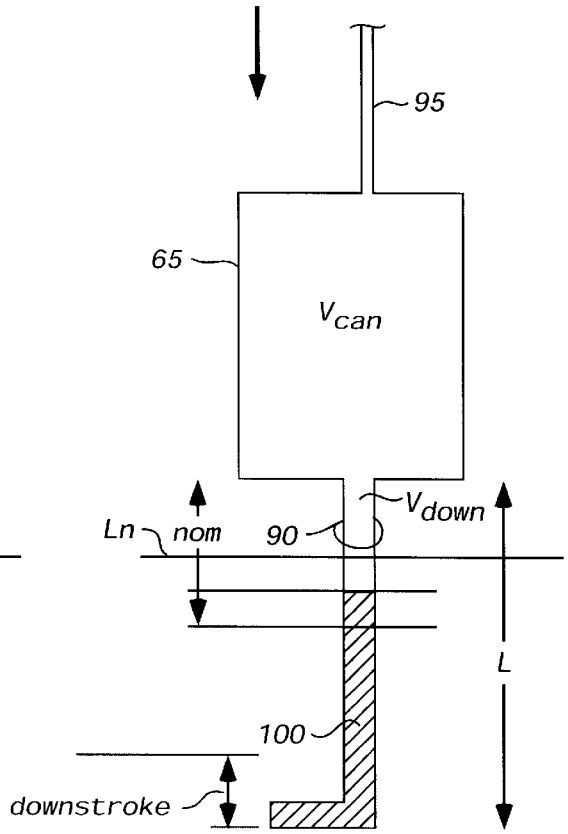
FIG. 10 shows the air can in FIG. 9 during a "downstroke" movement and illustrates how the volume in the passage decreases.

Further example embodiments of the invention are illustrated in FIGS. 7 and 8. FIG. 7 shows a single soft tank 65 with airline 95 and passage length L in a nominal position and FIG. 8 shows the same soft tank 65 in an "upstroke" position. When the soft tank 65 is at the nominal position as shown in FIG. 7, the air to water interface is at a first, "nominal" level Ln and the air volume in the tank and passage is equal to the sum of the volume in the tank $V_{Can}$ and the volume in the passage $V_{nom}$. As the soft tank 65 rises, as shown in FIG. 8, the air volume increases due to the decrease in pressure from the water 100 in passage 90 resulting in an air volume in passage 90 of $V_{Up}$ which is greater than $V_{nom}$. Likewise, FIGS. 9 and 10 illustrate the dynamic effects on a soft tank 65 when it is lowered in the water into a "downstroke" position. During the downward motion, the water in passage 90 increases due to the increase in water pressure resulting in a volume in the passage 90 of $V_{down}$ which is less than the volume $V_{nom}$. Thus, during operation, the level of the water in passage 90 or 75 raises and lowers in response to soft tank 65's vertical motion.

By keeping the cross-sectional area of the vertical portion of passage 90 (or 75 as shown in FIG. 4*a*), less than the cross-sectional area of soft tank 65, the change in the soft tank's buoyancy as it is raised or lowered is reduced. It will be seen from the above that, during pitch, since the cross-sectional area of passage 90 or 75 is less than the soft tank's cross-sectional area, the pitch sensitivity is also reduced, in comparison to convention soft tanks.

In some embodiments of the invention, passage 90 in FIGS. 7 and 9 or 75 in FIG. 4*a*, comprises corrosion resistant material (e.g. corrosion resistant alloys, such as stainless steel, and composite pipes, such as fiber-reinforced pipe, rubber hose, and others that will occur to those of skill in the art or corrosion resistant coatings, such as rust inhibiting paints, epoxies, and metallic coatings, such as electroplated metal surfaces, thermal sprayed aluminum, and other coatings that will occur to those of skill in the art). Since water is kept out of the soft tank by using this invention, the traditional problem of rapid corrosion at the air to water interface within the soft tank is relieved. Accordingly, it is also an aspect of the present invention to provide for a novel method of manufacture of a soft tank in which the soft tank is constructed of a first material and the passage is constructed of a second material in which the second material is more corrosion resistant than the first material. Other example embodiments of the method of manufacture include the fabrication of a passage within a first soft tank for fluid communication with a second soft tank, and connecting the second soft tank with the passage.

The embodiments of the invention described herein are only for purposes of illustration and understanding of the invention. Other embodiments of this invention can be devised which do not depart from the spirit of the invention as disclosed herein. Accordingly, the invention shall be limited in scope only by the attached claims.

What is claimed is:

1. A method of providing buoyancy to a riser when in water, the method comprising:

holding a volume of gas in mechanical connection with said riser;

providing a fluid passage between said volume of gas and said water, whereby said passage contains a level of water; and allowing said level of water to move within said fluid passage in response to vertical motion of said riser while resisting a change in said volume of gas as a result of the vertical motion of said riser.

2. A method as in claim 1 further comprising:

providing gas to said volume of gas.

3. A system for providing buoyancy to a riser when in water, the system comprising:

means for holding a volume of gas in mechanical connection with said riser;

means for providing a fluid path between said volume of gas and said water, whereby said path contains a level of water; and means for allowing said level of water to move within said fluid path in response to vertical motion of said riser while resisting a change in said volume of gas as a result of the vertical motion of said riser.

4. A system as in claim 3 further comprising means for providing gas to said volume of gas.

5. A system as in claim 3 wherein said means for holding comprises a tank connected to said riser.

6. A system as in claim 3 wherein said means for providing a fluid path comprises a passage from the gas to the water, wherein a cross-sectional area of said passage is less than a cross-sectional area of said means for holding.

7. A system as in claim 3 wherein said means for allowing said level of water to move within said fluid path comprises a passage having a length greater than an anticipated vertical motion of said riser.

8. A system for providing buoyancy to a riser when in water, the system comprising:

means for holding a volume of gas in mechanical connection with said riser;

means for providing a fluid path between said volume of gas and said water, whereby said path contains a level of water; and means for allowing said level of water to move within said fluid path in response to vertical motion of said riser while resisting a change in said volume of gas as a result of the vertical motion of said riser, wherein said means for allowing said level of water to move within said fluid path comprises a passage having a length greater than an anticipated vertical motion of said riser.

9. A system as in claim 8, further comprising means for providing gas to said volume of gas.

10. A system as in claim 8, wherein said means for holding comprises a tank connected to said riser.

11. A system as in claim 8, wherein said means for providing a fluid path comprises a passage from the gas to the water.

* * * * *